US006346358B1

(12) United States Patent
Cheng

(10) Patent No.: US 6,346,358 B1
(45) **Date of Patent: *Feb. 12, 2002**

(54) TONER PROCESSES

(75) Inventor: Chieh-Min Cheng, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/557,830

(22) Filed: Apr. 26, 2000

(51) Int. Cl.[7] ..... G03G 9/08

(52) U.S. Cl. ..... 430/137.14; 430/137.11; 430/137.17

(58) Field of Search ..... 430/137, 137.14, 430/137.11, 137.17; 427/213.34; 523/335

(56) References Cited

U.S. PATENT DOCUMENTS

| | | | | | |
|---|---|---|---|---|---|
| 3,674,736 | A | | 7/1972 | Lerman et al. | 260/41 R |
| 4,137,188 | A | | 1/1979 | Uetake et al. | 525/62.1 P |
| 4,254,201 | A | * | 3/1981 | Sawai et al. | 430/111 |
| 4,421,660 | A | * | 12/1983 | Solc | 523/202 |
| 4,558,108 | A | | 12/1985 | Alexandru et al. | 526/340 |
| 4,665,107 | A | * | 5/1987 | Micale | 523/335 |
| 4,797,339 | A | | 1/1989 | Maruyama et al. | 430/109 |
| 4,798,741 | A | * | 1/1989 | Nelson | 427/213.34 |
| 4,983,488 | A | | 1/1991 | Tan et al. | 430/137 |
| 4,996,127 | A | | 2/1991 | Hasegawa et al. | 430/109 |
| 5,066,560 | A | | 11/1991 | Tan et al. | 430/137 |
| 5,278,020 | A | | 1/1994 | Grushkin et al. | 430/137 |
| 5,290,654 | A | | 3/1994 | Sacripante et al. | 430/137 |
| 5,308,734 | A | | 5/1994 | Sacripante et al. | 430/137 |
| 5,344,738 | A | | 9/1994 | Kmiecik-Lawrynowicz et al. | 430/137 |
| 5,346,797 | A | | 9/1994 | Kmiecik-Lawrynowicz et al. | 430/137 |
| 5,348,832 | A | | 9/1994 | Sacripante et al. | 430/109 |
| 5,364,729 | A | | 11/1994 | Kmiecik-Lawrynowicz et al. | 430/137 |
| 5,366,841 | A | | 11/1994 | Patel et al. | 430/137 |
| 5,370,963 | A | | 12/1994 | Patel et al. | 430/137 |
| 5,403,693 | A | | 4/1995 | Patel et al. | 430/137 |
| 5,405,728 | A | | 4/1995 | Hopper et al. | 430/137 |
| 5,418,108 | A | | 5/1995 | Kmiecik-Lawrynowicz et al. | 430/137 |
| 5,496,676 | A | | 3/1996 | Croucher et al. | 430/137 |
| 5,501,935 | A | | 3/1996 | Patel et al. | 430/137 |
| 5,527,658 | A | | 6/1996 | Hopper et al. | 430/137 |
| 5,561,025 | A | | 10/1996 | Torres et al. | 430/137 |
| 5,585,215 | A | | 12/1996 | Ong et al. | 430/107 |
| 5,650,255 | A | | 7/1997 | Ng et al. | 430/137 |
| 5,650,256 | A | | 7/1997 | Veregin et al. | 430/137 |
| 5,766,817 | A | | 6/1998 | Cheng et al. | 430/137 |
| 5,766,818 | A | | 6/1998 | Smith et al. | 430/137 |
| 5,852,073 | A | * | 12/1998 | Villiger et al. | 523/161 |
| 5,944,650 | A | | 8/1999 | Hu et al. | 516/57 |
| 5,965,316 | A | * | 10/1999 | Kmiecik-Lawrynowicz et al. | 430/137 |

FOREIGN PATENT DOCUMENTS

| | | | |
|---|---|---|---|
| JP | 1-015749 | * | 1/1989 |

OTHER PUBLICATIONS

Grant, Roger et al. Grant and Hackh's Chemical Dictionary. New York: McGraw–Hill, Inc. pp. 422 and 451. (1987).*
Webster's II New Riverside Dictionary, p. 283. (1984).*

* cited by examiner

*Primary Examiner*—Christopher Rodee
(74) *Attorney, Agent, or Firm*—E. O. Palazzo

(57) ABSTRACT

A process for the preparation of an encapsulated colorant comprising the emulsion polymerization of a miniemulsion of monomer, colorant, ionic surfactant, cosurfactant, and optional nonionic surfactant, and wherein the resulting encapsulated colorant containing a polymer shell is of a diameter of from about 100 to about 1,000 nanometers.

28 Claims, No Drawings

TONER PROCESSES

PENDING APPLICATIONS AND PATENTS

Illustrated in U.S. Ser. No. 09/558,538 now U.S. Pat. No. 6,309,787, filed concurrently herewith, the disclosure of which is totally incorporated herein by reference, is a process comprising aggregating an encapsulated colorant with colorant particles, and wherein said encapsulated colorant is generated by a miniemulsion polymerization.

Illustrated in U.S. Ser. No. 08/959,798, pending entitled "Toner Processes", the disclosure of which is totally incorporated herein by reference, is a process for the preparation of toner comprising (i) aggregating a colorant dispersion containing a suitable surfactant with a latex emulsion containing an anionic surfactant, a nonionic surfactant, and a water miscible chain transfer agent, or a nonionic surfactant with chain transfer characteristics to form toner sized aggregates;

(ii) coalescing or fusing the aggregates; and optionally (iii) isolating, washing, and drying the resulting toner.

Illustrated in U.S. Pat. No. 5,944,650 and U.S. Pat. No. 5,766,818, the disclosures of each application being totally incorporated herein by reference, are cleavable surfactants and the use thereof in emulsion/aggregation and coalescence toner processes.

In U.S. Pat. No. 5,766,817, the disclosure of which is totally incorporated herein by reference, there is illustrated a process for the preparation of toner comprising (i) aggregating a colorant dispersion with a latex miniemulsion containing polymer, an ionic surfactant, a cosurfactant, and a nonionic surfactant;

(ii) coalescing or fusing the aggregates generated; and optionally (iii) cooling, isolating, washing, and drying the toner, and wherein the polymer in the miniemulsion is of a diameter of from about 50 to about 500 nanometers. The miniemulsion processes and the miniemulsions of this patent may be selected for the preparation of the encapsulated colorants of the present invention.

BACKGROUND OF THE INVENTION

The present invention is generally directed to colorant and toner processes, and more specifically, to processes which select aggregation and coalescence, or fusion of a polymer latex, colorant, such as pigment, dye, or mixtures thereof, and optional additive particles. In embodiments, the present invention is directed to processes which provide toner compositions with a volume average diameter of, for example, from about 1 micron to about 25 microns, and preferably from about 2 microns to about 12 microns, and a narrow particle size distribution of, for example, about 1.1 to about 1.45, both as measured by the Coulter Counter method. The resulting toners can be selected for known electrophotographic imaging and printing processes, including digital processes.

The present invention in aspects thereof is directed to a process for the preparation of toners by generating encapsulated colorant latexes or encapsulated colorants prepared by miniemulsion polymerization, wherein the miniemulsion latex emulsion is preferably submicron in size, of from, for example, about 100 nanometers to about 1,000 nanometers and preferably from about 200 nanometers to about 600 nanometers in volume average diameter, and contains a nonionic surfactant and an ionic surfactant of opposite charge polarity to that of the nonionic surfactant, thereafter heating the resulting mixture at, for example, below about the latex resin glass transition temperature, and more specifically, from about 35° C. to about 60° C. (Centigrade) to form toner sized aggregates of from about 2 microns to about 20 microns in volume average diameter, and which toner is comprised of polymer, colorant, especially pigment and optionally known toner additive particles, followed by heating the aggregate suspension above about the latex resin, or polymer glass transition temperature, and more specifically, at, for example, from about 70° C. to about 100° C. to effect coalescence or fusion of the components of the aggregates and to form mechanically stable integral toner particles. The miniemulsion can contain colorant, monomer, water, surfactants, and preferably a cosurfactant, such as an alcohol, an alkane, an ether, an alcohol ester, an amine, an alkyl thiol, a halide, or a carboxylic acid ester, which cosurfactant is preferably inert, nonvolatile, water insoluble, liquid at a temperature of from about 40° C. to about 90° C., and preferably contains a terminal aliphatic hydrocarbyl group with at least about 10 carbon atoms, and more specifically, from about 12 to about 24 carbon atoms, and mixtures thereof, and more specifically, an aliphatic alcohol with at least about 8 carbon atoms, such as from about 10 to about 25 carbon atoms, and an alkane with from about 10 to about 30 carbon atoms. The cosurfactant primarily functions to reduce the diffusion of monomer out of the monomer droplet and enables relatively stable miniemulsions because, it is believed, of the formation of intermolecular complexes at the oil/water interface. The complexes are believed to be liquid condensed and electrically charged thus creating a low, for example from about 0.5 dyne/centimeter to about 5 dynes/centimeter interfacial tension and high resistance to droplet coalescence.

The microencapsulation of colorant is an important area of research in paint and toner industries. Several benefits generated with encapsulation in accordance with the present invention include (1) improved particle dispersion in a resin matrix; (2) improved mechanical properties; (3) protection of the colorant from outside influences during toner processing; (4) protection of the matrix polymer from interaction with the colorant; and (5) excellent colorant encapsulation and uniform or substantial uniform toner triboelectric charging values, or passivation of the colorant.

With the present invention in embodiments, there is selected an encapsulated colorant generated by miniemulsion polymerization process. Aggregation/coalescence of the encapsulated colorant enable the generation of different color toners with uniform tribocharging. This results in toners with similar charging behavior independent of the colorant type.

The aforementioned toners are especially useful for imaging processes, especially xerographic processes, which usually require high toner transfer efficiency, such as those having a compact machine design without a cleaner, or those that are designed to provide high quality colored images with excellent image resolution and signal-to-noise ratio, and image uniformity.

PRIOR ART

There is illustrated in U.S. Pat. No. 4,996,127 a toner of associated particles of secondary particles comprising primary particles of a polymer having acidic, or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. The disadvantages of, for example, wide particle size distributions hence classification is usually required resulting in low toner yields, are illustrated in U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization.

In U.S. Pat. No. 5,561,025, the disclosure of which is totally incorporated herein by reference, there are illustrated emulsion/aggregation/coalescence processes wherein there are selected water phase termination agents, that is chain transfer agents that are not water miscible.

Other prior art that may be of interest includes U.S. Pat. Nos. 3,674,736;4,137,188 and 5,066,560.

Emulsion/aggregation processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; and 5,650,256.

Processes for the preparation of spherical toners at coalescence temperatures of from about 100° C. to about 120° C. are illustrated in U.S. Pat. No. 5,501,935, the disclosure of which is totally incorporated herein by reference.

The appropriate components and processes of the above patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant, especially pigment dispersions, thus enabling the achievement of excellent color print quality, and wherein there are selected encapsulated colorants.

It is another feature of the invention to provide a toner which eliminates the need for flushed pigments.

It is a further feature of the invention to provide a toner wherein the pigment particles can be dispersed in situ in a manner that they are less prone to migrate out of the toner.

A further feature of the invention is to provide a toner with high projection efficiency, such as from about 80 to about 98 percent efficiency as measured by the Match Scan II spectrophotometer available from Milton-Roy, for use in transparencies.

Additionally, it is another feature of the present invention to provide a process for obtaining a full process color set of four xerographic color toners, wherein the four toners are comprised of a cyan toner, a magenta toner, a yellow toner, and a black toner wherein the difference in tribocharging among the different four color toners is, for example, less than about 10 $\mu$C/gram, and preferably less than about 5 $\mu$C/gram, such as from 1 to about 4.

In a further feature of the present invention there is provided a process for the preparation of toner compositions with a volume average diameter of from between about 1 to about 25 microns, and preferably from about 2 to about 12 microns, and a particle size distribution of about 1.10 to about 1.35, and preferably from about 1.15 to about 1.25 as measured by a Coulter Counter without the need to resort to conventional classifications to narrow the toner particle size distribution, and wherein there are selected encapsulated colorants.

Moreover, in another feature of the present invention there is provided a process for the preparation of toner by aggregation and coalescence, or fusion (aggregation/coalescence) of encapsulated colorant, and additive particles, and wherein the encapsulated colorant is formed from a semicontinuous miniemulsion process, and there is included therein colorant, a cosurfactant, or a hydrotrope, small water soluble molecules with minimum surface activity, such as sodium xylene sulfonate or sodium toluene sulfonate, which can be selected to enhance latex polymer stability and reduce the amount of undesirable sediment, and wherein there results an encapsulated colorant dispersion that can be aggregated with colorant particles.

In yet another feature of the present invention there are provided toner compositions with low fusing temperatures of from about 120° C. to about 180° C., and which toner compositions exhibit excellent blocking characteristics at and above about 45° C., and wherein there are selected encapsulated colorants.

These and other features of the present invention are accomplished in embodiments by the provision of toners and processes thereof. In embodiments of the present invention, there are provided encapsulated colorant processes for the preparation of toner compositions by the aggregation/coalescence of the colorant encapsulated by a polymer in the presence of a cosurfactant, and wherein the temperature of the aggregation may be selected to control the aggregate size, and thus the final toner particle size, and the coalescence temperature and time may be utilized to control the toner shape and surface properties.

Aspects of the present invention relate to a process for the preparation of an encapsulated colorant comprising the emulsion polymerization of a miniemulsion of monomer, colorant, ionic surfactant, cosurfactant, and optional nonionic surfactant, and wherein the resulting encapsulated colorant containing a polymer shell is of a diameter of from about 100 to about 1,000 nanometers; a process wherein the diameter is from about 200 to about 600 nanometers, the encapsulated colorant containing a polymer shell is aggregated below about the polymer glass transition temperature, followed by coalescing or fusing of the aggregates above about the polymer or resin shell glass transition temperature, and wherein there results a toner with a size of from about 2 to about 20 microns in volume average diameter; a process wherein the temperature below the polymer shell glass transition temperature is from about 25° C. to about 60° C., and the heating above the polymer shell glass transition temperature is from about 60° C. to about 100° C.; a process wherein the temperature below the glass transition temperature is from about 35° C. to about 55° C., and the heating above the glass transition temperature is from about 70° C. to about 95° C.; a process wherein the temperature at which the aggregation is accomplished controls the size of the aggregates, and wherein the toner size is from about 2 to about 12 microns in volume average diameter, and wherein the temperature and time of the coalescence or fusion of the components of aggregates control the shape of the resultant toner; a process wherein the aggregation temperature is from about 45° C. to about 55° C., and wherein the coalescence or fusion temperature is from about 80° C. to about 95° C.; a process wherein the cosurfactant is selected from the group consisting of alkanes, hydrocarbyl alcohols, ethers, alkyl thiols, amines, halides, and esters, and wherein the cosurfactant optionally possesses from about 10 to about 24 carbon atoms; a process wherein the cosurfactant is an alkane with from about 10 to about 24 carbon atoms, and wherein the alkane is present in an amount of from about 0.05 to about 5 weight percent based primarily on the amount of monomer; a process wherein the cosurfactant is an alcohol, or an alkyl thiol; a process wherein the alcohol contains from about 8 to about 20 carbon atoms; a process wherein the alcohol is decanol, lauryl alcohol, tetradecanol, cetyl alcohol, or octadecanol; a process wherein the alcohol is present in an amount of from about 0.1 to about 5 weight percent; a process wherein the cosurfactant is an alkane of n-decane, dodecane, tetradecane, hexadecane, octadecane octyne, dodecyl cyclohexane, or hexadecyl benzene; a process wherein the alkyl thiol contains from about 10 to about 18 carbon atoms; a process wherein the alkyl thiol is decanethiol, 1 -dodecanethiol, t-dodecanethiol, or octadecanethiol; a process wherein the alkyl thiol is present in an amount of from about 0.1 to about 5 weight percent; a process wherein the colorant is a pigment; a process wherein the aggregates are formed in the presence of a cationic surfactant; a process wherein the aggregation is accomplished at a temperature of from about 15° C. to about 1° C. below the Tg of the polymer shell for an optional duration of from about 0.5 hour to about 3 hours; a process wherein the coalescence or fusion of the components of aggregates for the formation of integral toner particles comprised of colorant and polymer binder is accomplished at a temperature of about 85° C. to about 105° C. for a duration of from about 1 hour to about 5 hours; a process wherein the polymer formed is selected from the group consisting of poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(alkyl methacrylate-2-carboxyethyl acrylate), poly(styrene-alkyl acrylate-2-carboxyethyl acrylate), poly(styrene-alkyl acrylate-acrylonitrile-2-carboxyethyl acrylate), poly(styrene-1,3-diene-acrylonitrile-2-carboxyethyl acrylate), and poly(alkyl acrylate-acrylonitrile-2-carboxyethyl acrylate), wherein the polymer is optionally present in an amount of from about 80 percent by weight to about 99 percent by weight of toner; a process wherein the polymer shell is poly(styrene-alkyl acrylate-acrylic acid), poly(styrene-1,3-diene-acrylic acid), or poly (styrene-alkyl acrylate-2-carboxyethyl acrylate); a process wherein the polymer shell and the toner polymer is selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-2-carboxyethyl acrylate), poly(styrene-butadiene-acrylonitrile-2-carboxyethyl acrylate), poly(styrene-butyl acrylate-2-carboxyethyl acrylate), and poly(styrene-butyl acrylate-acrylononitrile-2-carboxyethyl acrylate); a process wherein the polymer shell and the toner polymer are poly(styrene-butyl acrylate-acrylic acid), poly(styrene-butyl acrylate-2-carboxyethyl acrylate), or poly(styrene-butadiene-acrylic acid); a process wherein the ionic surfactant is selected from the group consisting of sodium dodecyl sulfate, sodium dodecylbenzene sulfate, sodium dodecylnaphthalene sulfate, and sodium tetrapropyl diphenyloxide disulfonate; a process wherein the colorant is carbon black, magnetite, cyan, yellow, magenta, and mixtures thereof; a process wherein the toner particles isolated are from about 2 to about 10 microns in volume average diameter, and the particle size distribution thereof is from about 1.15 to about 1.30, wherein each of the surfactants utilized represents from about 0.01 to about 5 weight percent of the total reaction mixture, and wherein there is optionally added to the surface of the formed toner metal salts, metal salts of fatty acids, silicas, metal oxides, or mixtures thereof, each in an amount of from about 0.1 to about 10 weight percent of the obtained toner particles; a process wherein the solids of the miniemulsion of monomer, colorant, and surfactants is of a diameter of from about 200 to about 600 nanometers; a process for the preparation of toner which comprises aggregating a component comprised of a colorant core and a polymer shell;

coalescing the aggregates generated; and optionally isolating the toner, and wherein the component is generated by the emulsion polymerization of an emulsion of water, colorant, monomer, ionic surfactant, nonionic surfactant and optional cosurfactant; a process wherein the cosurfactant is present, and the emulsion is a miniemulsion with a size diameter for the solids thereof of from about 100 to about 1,000 nanometers; a process wherein the toner is isolated; a process wherein the toner is isolated, washed, and dried; a process wherein the colorant encapsulated in the polymer shell is prepared by a free radical-initiated aqueous miniemulsion polymerization of a mixture of olefinic monomers, free radical initiator, chain transfer agent, surfactant, cosurfactant, and water, wherein the amount of monomers selected is from about 1 to about 40 weight percent, and the amount of water is from about 59 to about 98 weight percent, based on the total reaction mixture amount; heating at a temperature of between about 45° C. to about 90° C., wherein the resulting polymer possesses a number average molecular weight of from about 1,000 grams per mole to about 200,000 grams per mole, a weight average molecular weight of from about 5,000 grams per mole to about 500,000 grams per mole, and a glass temperature of from about 40° C. to about 120° C., wherein the colorant is present in an amount of from about 1 to about 25 weight percent based on the monomer amount, the free radical initiator is selected in an amount of from about 0.1 to about 10 weight percent based on the monomer or monomers amount, the chain transfer agent is selected in an amount of from about 0.5 to about 10 weight percent based on the monomer or monomers amount, the surfactant is selected in an amount of from about 0.1 to about 10 weight percent based on the monomer or monomers amount, the cosurfactant is selected in an amount of from about 0.005 to about 5 weight percent, based on the monomer or monomers amount, the latex polymer emulsion is comprised of from about 1 to about 40 weight percent of monomer particles, and which miniemulsion is of an average diameter of from about 100 nanometers to about 1,000 nanometers, as measured by light scattering technique on a Coulter N4 Plus Particle Sizer; a process wherein the miniemulsion is comprised of water, colorant, and surfactants wherein the ionic surfactant is of a negative polarity, and the cosurfactant and nonionic surfactant are each of a natural polarity; a process wherein polymerization of the monomer is accomplished by heating; a process wherein the heating is at a temperature of from about 45° C. to about 95° C.;

(i) aggregating a colorant encapsulated polymer from a miniemulsion containing colorant, polymer, an ionic surfactant, a cosurfactant, and a nonionic surfactant;

(ii) coalescing or fusing the aggregates generated; and optionally (iii) cooling, isolating, washing, and drying the toner, and wherein the colorant encapsulated latex polymer in the miniemulsion is of a diameter of from about 100 to about 1,000 nanometers; a process wherein the aggregating is below about the polymer shell glass transition temperature, the coalescing or fusing of the aggregates is above about the polymer glass transition temperature, and wherein the colorant encapsulated polymer particle diameter is from about 200 to about 600 nanometers, and there results a toner with a size of from about 2 to about 20 microns in volume average diameter; a process wherein the temperature below the glass transition temperature is from about 25° C. to about 65° C., and the heating above the glass transition temperature is from about 70° C. to about 100° C.; a process wherein the temperature below the glass transition temperature is from about 35° C. to about 55° C., and the heating above the glass transition temperature is from about 70° C. to about 95° C.; a process wherein the temperature at which the aggregation is accomplished controls the size of the aggregates, and wherein the final toner size is from about 2 to about 10 microns in volume average diameter, and wherein the temperature and time of the coalescence or fusion of the components of aggregates control the shape, such as spherical, of the resultant toner; a process wherein the aggregation temperature is from about 45° C. to about 55° C., and wherein the coalescence or fusion temperature is from about 80° C. to about 95° C.; a process wherein the cosurfactant is selected from the group consisting of components of alkanes, hydrocarbyl alcohols, ethers, alkyl thiols, amines, halides, and esters; a process wherein the cosurfactant is an alkane; a process wherein the alkane is n-decane, dodecane, tetradecane, hexadecane, octadecane, and the like, and wherein the alkane is present in an amount of from about 0.05 to about 5 parts; a process wherein the cosurfactant is an alcohol, or an alkyl thiol; a process wherein the alcohol contains from about 10 to about 27 carbon atoms, mixtures thereof and the like; a process wherein the alcohol is decanol, lauryl alcohol, tetradecanol, cetyl alcohol, stearyl alcohol, or octadecanol; a process wherein the alcohol is present in an amount of from about 0.1 to about 5 parts; a process wherein the alkyl thiol contains from about 10 to about 18 carbon atoms; a process wherein the alkyl thiol is decanethiol, 1-dodecanethiol, t-dodecanethiol, or octadecanethiol, and the like; a process wherein the colorant is a pigment, and wherein the pigment dispersion contains an ionic surfactant, and the minilatex emulsion contains a nonionic surfactant and an ionic surfactant of opposite charge polarity to that of the ionic surfactant present in the pigment dispersion; a process wherein the surfactant utilized in the colorant dispersion is a cationic surfactant, and the ionic surfactant present in the latex mixture is an anionic surfactant; a process wherein the aggregation is accomplished at a temperature of from about 15° C. to about 1° C. below the Tg of the polymer, or latex resin for a duration of from about 0.5 hour to about 3 hours; a process wherein the coalescence or fusion of the components of aggregates for the formation of integral toner particles comprised of colorant, resin and additives is accomplished at a temperature of about 85° C. to about 105° C. for a duration of from about 1 hour to about 5 hours; a process wherein the shell polymer or coating is selected from the group consisting of poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly(styrene-alkyl methacrylate-acrylic acid), poly(styrene-alkyl acrylate-2-carboxyethyl acrylate), poly(styrene-1,3-diene-2-carboxyethyl acrylate), poly(styrene-alkyl methacrylate-2-carboxyethyl acrylate), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(alkyl methacrylate-2-carboxyethyl acrylate), poly(styrene-alkyl acrylate-acrylonitrile-2-carboxyethyl acrylate), poly(styrene-1,3-diene-acrylonitrile-2-carboxyethyl acrylate), and poly(alkyl acrylate-acrylonitrile-2-carboxyethyl acrylate), and wherein the polymer is present in an amount of from about 80 percent by weight to about 99 percent by weight of toner, and wherein the colorant is a pigment; a process wherein the polymer is selected from the group consisting of poly(styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly (butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly (butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-2-carboxyethyl acrylate), poly(styrene-butadiene-acrylonitrile-2-carboxyethyl acrylate), poly(styrene-butyl acrylate-2-carboxyethyl acrylate), poly(styrene-butyl acrylate-acrylononitrile-2-carboxyethyl acrylate), and the like, and wherein the polymer is optionally present in an amount of from about 80 percent by weight to about 99 percent by weight of toner, and wherein the colorant is a pigment or a dye; a process wherein the anionic surfactant is selected from the group consisting of sodium dodecyl sulfate, sodium dodecylbenzene sulfate, sodium dodecyinaphthalene sulfate, and sodium tetrapropyl diphenyloxide disulfonate, and wherein colorant dispersion contains a cationic surfactant of a quaternary ammonium salt; a process wherein the colorant is carbon black, magnetite, cyan, yellow, magenta, and mixtures thereof; a process wherein the toner particles isolated are from about 2 to about 12 microns in volume average diameter, and the particle size distribution thereof is from about 1.15 to about 1.30, wherein each of the surfactants utilized represents from about 0.01 to about 5 weight percent of the total reaction mixture, and wherein there is added to the surface of the formed toner metal salts, metal salts of fatty acids, silicas, metal oxides, or mixtures thereof, each in an amount of from about 0.1 to about 10, and preferably from about 1 to about 3 weight percent of the obtained toner particles; a process wherein the monomer in the miniemulsion is of a diameter of from about 100 to about 1,000 nanometers, or wherein the monomer in the miniemulsion is of a diameter of from about 200 to about 600 nanometers; a process for the preparation of toner which comprises aggregating an encapsulated colorant with a latex miniemulsion containing polymer of a diameter of from about 100 to about 1,000 nanometers, an ionic surfactant, an optional cosurfactant, and a nonionic surfactant;

coalescing the aggregates generated; and optionally isolating, washing, and drying the toner; toner processes comprised of blending an encapsulated aqueous latex colorant dispersion containing, for example, a pigment, such as HELIOGEN BLUE™ or HOSTAPERM PINK™, and a cationic surfactant, such as benzalkonium chloride (SANIZOL B-50™), and wherein the latex miniemulsion contains an anionic surfactant, such as sodium dodecylbenzene sulfonate (for example NEOGEN R™ or NEOGEN SC™), sodium tetrapropyl diphenyloxide disulfonate (for example DOWFAX 2A1™) and cosurfactant, and wherein the latex polymer is derived from emulsion polymerization of monomers selected, for example, from the group consisting of styrene, acrylates, methacrylates, acrylonitrile, butadiene, acrylic acid, methacrylic acid, 2-carboxyethyl acrylate, and the like, thereby resulting in the flocculation of the polymer particles with the pigment particles and optional additives; and which flocculent mixture, on further stirring at a temperature of from about 35° C. to about 60° C., results in the formation of toner sized aggregates having an aggregate size of from about 2 microns to about 20 microns in volume average diameter as measured by the Coulter Counter (Microsizer II), and a particle size distribution of about 1.15 to about 1.35; thereafter, heating the aggregate suspension at from about 70° C. to about 95° C. to form toner particles; followed by filtration, washing, and drying in an oven, or the like; processes for the preparation of toner compositions which comprise blending a polymer encapsulated colorant preferably containing a pigment, such as carbon black, phthalocyanine, quinacridone or RHODAMINE B™ type red, green, brown, and the like with a cationic surfactant, such as benzalkonium chloride, wherein the polymer is generated from a minilatex emulsion derived from the emulsion polymerization of monomers selected from the group consisting of styrene, butadiene, acrylates, methacrylates, acrylonitrile, acrylic acid, methacrylic acid, 2-carboxyethyl acrylate, and the like, and which latex contains an anionic surfactant, such as sodium dodecylbenzene sulfonate or sodium tetrapropyl diphenyloxide disulfonate, a nonionic surfactant, and a cosurfactant, and which colorant encapsulated latex resin size is, for example, from about 100 to about 1,000 nanometers, and preferably from about 200 to about 600 nanometers as measured by light scattering technique on a Coulter N4 Plus Particle Sizer; heating the resulting flocculent mixture at a temperature below or about equal to the Tg of the polymer or resin formed in the latex, ranging, for example, from about 30° C. to about 55° C. for an effective length of time of, for example, 0.5 hour to about 2 hours to form toner sized aggregates; and subsequently heating the aggregate suspension at a temperature at or above the Tg of the latex polymer, for example from about 60° C. to about 100° C., to provide toner particles; and finally isolating the toner product by filtration, thereafter washing and drying in an oven, fluid bed dryer, freeze dryer, or spray dryer; whereby toner particles comprised of polymer, or resin, colorant, and optional additives are obtained.

The colorant encapsulated polymer is preferably prepared by a free radical-initiated aqueous miniemulsion polymerization of a mixture of from about 1 to about 10 monomers, and preferably from about 2 to about 5 monomers, olefinic monomers, free radical initiator, chain transfer agent, surfactant, cosurfactant, and water, wherein the amount of monomer or monomers selected is, for example, from about 1 to about 40 weight percent, and the amount water is from about 59 to about 98 weight percent, based on the total reaction mixture amount by heating at, for example, temperatures of between about 45° C. to about 90° C., wherein the resulting latex polymer still possesses, for example, a number average molecular weight of from about 1,000 grams per mole to about 200,000 grams per mole, and a weight average molecular weight of from about 5,000 grams per mole to about 500,000 grams per mole, and a glass temperature of from 40° C. to about 120° C. The colorants selected are present in various effective amounts, such as from about 1 to about 25, and preferably from about 2 to about 14 weight percent based on the total monomer or monomers used to prepare the polymer resin. The free radical initiator is selected in amounts of, for example, from about 0.1 to about 10 weight percent based on the total monomer or monomers selected to prepare the polymer resin. Chain transfer agents are selected in amounts of from about 0.5 to about 10 weight percent based on the total monomer or monomers selected to prepare the polymer resin. Surfactants are selected in amounts of from about 0.1 to about 10 weight percent based on the total monomer or monomers selected to prepare the polymer resin. Cosurfactant is selected in various suitable amounts, such as from about 0.005 to about 5, and preferably from about 0.5 to about 3 weight percent, based on the total monomer or monomers selected to prepare the polymer resin. The latex monomer emulsion is preferably comprised of from about 1 to about 65 weight percent of monomer particles, of average diameter of from about 100 nanometers to about 1,000 nanometers, as measured by light scattering technique on a Coulter N4 Plus Particle Sizer.

With the present invention there is selected in embodiments a colorant encapsulated latex preferably generated by a semicontinuous, miniemulsion polymerization process, followed by aggregation/coalescence of the colorant encapsulated polymer to enable toners with at least four different colors of cyan, yellow, magenta, and black different color toners with uniform tribocharging wherein the difference in tribocharging among the different four color toners is, for example, less than about 10 $\mu$C/gram, and preferably less than about 5 $\mu$C/gram, such as from about 1 to about 7.

More specifically, with the present invention in embodiments thereof there is selected a semicontinuous, miniemulsion polymerization process to encapsulate colorants and to form colorant encapsulated polymers. Generally, the process of the present invention can be referred to as a miniemulsion polymerization, since the primary colorant particles are dispersed in a monomer or mixture of monomers, with polymerization subsequent to emulsification. The miniemulsion process generates, for example, a water oil emulsion wherein the amount of oil is from about 0.5 to about 80 weight percent, and preferably from about 5 to about 75 weight percent, and the amount of water is from about 20 to about 99.5 weight percent, and preferably from about 25 to about 95 weight percent, based on the total oil and water mixture. Subsequently, the resulting miniemulsion together with initiator can be heated at elevated temperature, for example temperatures of between about 35° C. to about 120° C., and preferably between about 45° C. to about 90° C. to accomplish the emulsion polymerization. The encapsulation of colorant particles with the miniemulsion polymerization process offers certain advantages over conventional methods such as the direct dispersion of the particles in the oil medium, rather than in the water phase, by using homogenization in the presence of surfactants. A homogenization is selected to provide a suitable shear to enable the miniemulsion with the colorant particles located inside the miniemulsion droplets. A semicontinuous addition of the miniemulsion to the reactor system will provide excellent stability of the miniemulsion preventing particle coalescence or flocculation among the interactive monomer emulsion droplets, and maintaining particle size in the range of from about 100 to about 1,000 nanometers, and preferably from about 200 to about 600 nanometers, improved latex stability and colorant encapsulation, the amount of colorant being encapsulated within the polymer particle being, for example, from about 80 to about 98 percent, based on the total amount of colorant used for the preparation of the colorant encapsulated latex.

Miniemulsions are relatively stable submicron, for example, about 100 to about 1,000 nanometers dispersions of oil (monomer) in water prepared by shearing a composition containing monomers, water, initiator, chain transfer agent, surfactant, cosurfactant, and additionally, colorant. A principle involved in the preparation of stable miniemulsion, which stability can be maintained by using a cosurfactant, which prevents particle coalescence or flocculation among the interactive monomer emulsion droplets, is the introduction of a low molecular weight, for example $M_w$ of the cosurfactant is not more than about 5,000, preferably not more than about 2,000, and still more preferably from about 100 to about 500, and which cosurfactants are water insoluble to the extent that in water they have a solubility of less than about $10^{-3}$ grams, preferably less than about $10^{-4}$ grams, and more preferably from about $10^{-6}$ grams to about $10^{-4}$ grams per liter of water to substantially retard the diffusion of monomer and of the emulsion droplet. A cosurfactant usually is comprised of a long chain alcohol or alkane of, for example, at least 10 carbon atoms, and preferably from about 12 to about 24 carbon atoms in length.

The cosurfactant as indicated herein primarily functions to reduce the diffusion of monomer from the monomer droplet, for example the cosurfactant can reduce the monomer diffusion to an extent of about 75 to about 95 percent and enable relatively stable miniemulsions since, it is believed, there is formed intermolecular complexes at the oil/water interface. The enhanced stability in miniemulsions is attributed to the formation of intermolecular complexes at the oil/water interface, which is comprised of solidified bilayers of anionic surfactant and cosurfactant separated by water. The macrostructure of the bilayers is comprised of a tortuous network of irregularly shaped aggregates with diameters between about 5 to about 100 nanometers. The complexes can be considered liquid condensed (the bilayer network separated by water) and the surface charge (zeta-potential) of the miniemulsions is, for example, from about 50 to about 120 mV, and preferably from about 60 to about 100 mV, as determined by the PenKem System 3000 Electrophoresis; and a low interfacial tension, for example from about 0.5 dyne/centimeter to about 5 dyne/centimeter, and high resistance to colorant transport/leaching.

In conventional emulsion polymerization (in the absence of a long chain alcohol or alkane surfactant and/or high shear), the primary mechanisms of particle nucleation are micellar and/or homogeneous nucleation, i.e., the principal locus of particle nucleation is the aqueous phase or the monomer swollen micelles. Monomer droplets (>1000 nanometers) act as monomer reservoirs supplying monomer to the growing polymer particles. In contrast, miniemulsion polymerizations utilize a surfactant/cosurfactant system to produce small (100 to 1,000 nanometers) monomer droplets. The small droplet size, and consequent large droplet surface area in a miniemulsion results in most of the surfactant being adsorbed to the droplets with little free surfactant available to form micelles or stabilize aqueous-phase polymerization.

Hence, there may be little or no micellar or homogeneous nucleation. The droplets become the primary locus of particle nucleation. Particle nucleation in miniemulsion polymerization is predominantly from small monomer droplets stabilized against Ostwald ripening.

Long chain aliphatic mercaptans such as dodecyl mercaptan are commonly used as chain transfer agents to regulate polymer molecular weight in the emulsion polymerization. These mercaptans are usually water-insoluble and could be used as hydrophobes to stabilize the miniemulsion droplets against monomer diffusion and colorant leaching. The miniemulsions stabilized with long chain aliphatic mercaptans are thermodynamically stable. These chain transfer agents may also function as a cosurfactant to stabilize the miniemulsion and the colorant can thus be more easily incorporated into the polymer particles, resulting in homogeneous colorant encapsulated latex composition.

Examples of ethylenically unsaturated monomers include, for example, vinyl aromatic and aliphatic hydrocarbons such as styrene, α-methyl styrene and similar substituted styrenes, vinyl naphthalene, vinyl toluene, divinyl benzene, and vinyl aliphatic hydrocarbons such as 1,3-butadiene, methyl-2-butadiene, 2,3-dimethyl butadiene, cyclopentadiene and dicyclopentadiene as well as ethylenically unsaturated esters such as acrylic, methacrylic, cinnamic and crotonic and the like and esters containing fumaric and maleic type unsaturation, and acid olefinic monomers such as acrylic acid, methacrylic acid, itaconic acid, fumaric acid, maleic acid, 2-carboxyethyl acrylate, sodium acrylate, potassium acrylate, and the like. Particularly preferred monomers include, for example, styrene, 1,3-butadiene, isoprene, alkyl (meth)acrylates such as ethyl acrylate, butyl acrylate, methyl methacrylate, butyl methacrylate, acrylonitrile, vinyl acetate, acrylic acid, methacrylic acid, and 2-carboxyethyl acrylate.

Examples of the polymers formed from the monomers include poly(styrene-butadiene), poly(methylstyrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), poly(styrene-butadiene-2-carboxyethyl acrylate), poly(styrene-butadiene-acrylonitrile-2-carboxyethyl acrylate), poly(styrene-butyl acrylate-2 carboxyethyl acrylate), and poly(styrene-butyl acrylate-acrylononitrile-2-carboxyethyl acrylate).

Generally, the ethylenically unsaturated ester, styrene functional monomer or other suitable monomer, is from about 75 to about 99 percent by weight of the shell polymer and wherein the polymer is the product of miniemulsion polymerization of monomer and colorant. The olefinic acidic monomer utilized, such as acrylic acid, methacrylic acid or 2-carboxyethyl acrylate, is from about 0 to about 25 weight percent of the polymer resin. For example, the resin could be poly(styrene-butyl acrylate-2-carboxyethyl acrylate).

The free radical initiator utilized is generally an emulsion type water-soluble initiator, such as a persulfate like potassium, sodium, or ammonium persulfate, or oil-soluble initiators, such as benzyl peroxide, lauroyl peroxide, 2,2'-azobis(isobutyronitrile), or 2,2'-azobis-(2-methylbutyronitrile), or mixtures thereof. The free radical is selected in amounts of from about 0.1 to about 10 weight percent based on the total monomer or monomers used to prepare the polymer resin. The chain transfer agents are utilized to adjust the molecular weight of the resin and for adjusting the resin particle to solubilized resin ratio. Chain transfer agents selected include alkylthiol such as 1-dodecanethiol, about 0.5 to about 10 percent on weight, halogenated carbons such as carbon tetrabromide, about 0.1 to about 10 percent on weight, based on the monomer, or monomers used to prepare the polymer resin, or preferably an alkylthiol.

Cosurfactants include, for example, alkanes, and hydrocarbyl alcohols, ethers, amines, halides and esters, which are for example, in instances, inert, nonvolatile, water insoluble, liquids at a temperature of from about 40° C. to about 90° C., and contain a terminal aliphatic hydrocarbyl group, and mixtures thereof. The terminal aliphatic hydrocarbyl group of at least about 10, and more specifically, from about 10 to about 20 carbon atoms contained therein may be unsaturated, but is preferably saturated, and branched, and is preferably a straight chain. These cosurfactants should be relatively highly water insoluble to the extent that in water they have a solubility of less than about $10^{-3}$ grams, preferably less than about $10^{-4}$ grams, and more preferably from about $10^{-6}$ grams to about $10^{-4}$ grams per liter of water. The molecular weight $M_w$ of the cosurfactant is, for example, not more than about 5,000, preferably not more than about 2,000, and still more preferably from about 100 to about 500. Examples of specific cosurfactants include alkanes, such as n-decane, n-tetradecane, n-hexadecane, n-octadecane, eicosane, tetracosane, 1-decene, 1-dodecene, 2-hexadecyne, 2-tetradecyne, 3-octyne, 4-octyne, and 1-tetradecene; alicyclic hydrocarbons, such as dodecyl cyclohexane; aromatic hydrocarbons, such as hexadecyl benzene; alcohols, such as decanol, lauryl alcohol, tetradecanol, cetyl alcohol, octadecanol, eicosanol, 1-heptadecanol and ceryl alcohol; hydrocarbyl alcohol esters of lower molecular weight carboxylic acids, such as cetyl acetate; ethers, such as octyl ether and cetyl ether; amines, such as tetradecyl amine, hexadecyl amine, and octadecyl amine; halides, such as hexadecyl chloride and other chlorinated paraffins; hydrocarbyl carboxylic acid esters of lower molecular weight alcohols, such as methyl, ethyl and isoamyl octanoate, methyl and octyl caprate, ethyl stearate, isopropyl myristate, methyl, isoamyl and butyl oleate, glyceryl tristearate, soybean oil, coconut oil, tallow, laurin, myristin, olein and the like. With the processes of the present invention, cosurfactants as illustrated herein are selected, preferably cosurfactants of dodecane, hexadecane, lauryl alcohol, or cetyl alcohol, and which cosurfactant is selected in various suitable amounts, such as from about 0.005 to about 5, and preferably from about 0.5 to about 3 weight percent, or parts based on the monomer, or monomers used to prepare the polymer resin. The cosurfactants increase the stability of the fine-size particle emulsions by inhibiting sedimentation or degradation caused by the tendency of the small particles or droplets to coalescence or diffuse molecularly. The cosurfactants should preferably be inert, and resistant to diffusion into aqueous medium.

Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants, such as pigments, present in the toner in an effective amount of, for example, from about 1 to about 20 percent by weight of toner, and preferably in an amount of from about 2 to about 12 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue, or mixtures thereof. Specific examples of pigments include phthalocyanine HELIOGEN BLUE L6900™, D6840™, D7080™, D7020™, PYLAM OIL BLUE™, PYLAM OIL YELLOWS™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, red, brown, orange, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans that may be used include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Colorants include pigment, dye, mixtures of pigment and dyes, mixtures of pigments, mixtures of dyes, and the like. More specifically, pigment examples include Pigment Blue 15:3 having a Color Index Constitution Number of 74610, magenta pigment Pigment Red 81:3 having a Color Index Constitution Number of 45160:3, Yellow 17 having a Color Index Constitution Number of 21105, and carbon black. The pigments selected are present in various effective amounts, such as from about 1 to about 20, and preferably from about 2 to about 12 weight percent of the toner.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like. Also, additives to improve flow characteristics and charge additives, if not initially present, to improve charging characteristics may then be added by blending with the formed toner, such additives, including AEROSILS® or silicas, metal oxides like tin, titanium and the like, metal salts of fatty acids like zinc stearate, and which additives are present in various effective amounts, such as from about 0.1 to about 10 percent by weight of the toner.

Surfactants in effective amounts of, for example, 0.01 to about 15 weight percent of the reaction mixture in embodiments include, for example, nonionic surfactants, such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ in effective amounts of, for example, from about 0.1 to about 10 percent by weight of the reaction mixture; anionic surfactants such as, for example, sodium dodecylsulfate (SDS), sodium dodecylbenzene sulfonate, sodium tetrapropyl diphenyloxide disulfonate, sodium dodecyinaphthalene sulfate, dialkyl benzenealkyl sulfates and sulfonates, abitic acid, available from Aldrich, NEOGEN R™, NEOGEN SC™ obtained from Kao, DOWFAX 2A1™ obtained from Dow, and the like, in effective amounts of, for example, from about 0.01 to about 10 percent by weight; cationic surfactants, such as, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to about 4.

Examples of the surfactant, which are added to the aggregates before coalescence is initiated, can be anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant utilized in the coalescence to primarily stabilize the aggregate size against further growth with temperature is, for example, from about 0.01 to about 10 percent by weight, and preferably from about 0.5 to about 5 percent by weight of monomers used to prepare the copolymer resin.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Also, there can be selected as carrier particles, or components a core with a coating thereover of polymethylmethacrylate with a conductive component dispersed therein, such as a conductive carbon black.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various pieces of the present invention. These Examples are intended to be illustrative only and are not intended to limit the scope of the present invention.

EXAMPLE I

Encapsulated Yellow Pigment Synthesis

An encapsulated yellow pigment comprised of a yellow pigment core and a styrene/n-butyl acrylate/2-carboxyethyl acrylate terpolymer shell was synthesized by a semicontinuous, miniemulsion polymerization process. 1-Dodecanethiol, having solubility in water of $3\times10^{-5}$ grams per liter of water at 25° C., was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 756 grams of deionized water were deaerated for 30 minutes while the temperature was raised to 80° C. A miniemulsion was prepared by homogenizing a monomer mixture (290 grams of styrene, 97 grams of n-butyl acrylate, 23.2 grams of 2-carboxyethyl acrylate, 1.9 grams of 2,2'-azobis(2-methylbutyronitrile), 15.5 grams of 1-dodecanethiol, and 33.5 grams of Yellow 17 pigment with an aqueous solution, 1.3 grams of DOWFAX 2A1™, 0.4 gram of ANTAROX CA-897™, 3.9 grams of ammonium persulfate, and 224 grams of deionized water via VirTishear Cyclone Homogenizer at 10,000 rpm for 30 minutes at room temperature. The miniemulsion was fed into the reactor over a period of 105 minutes. At the conclusion of the monomer feed, the emulsion was post-heated at 80° C. for 30 minutes, then there was added an initiator aqueous solution (1.9 grams of ammonium persulfate and 20 grams of deionized water). After the above initiator addition was completed, the reaction was allowed to post react for 90 minutes at 80° C., then cooled to 25° C. The resulting encapsulated yellow pigment contained 28 percent solids comprised of poly(styrene-butyl acrylate-2-carboxyethyl acrylate) and Yellow Pigment 17, and possessed an average particle size of 395 nanometers as measured by light scattering technique on a Coulter N4 Plus Particle Sizer, and more specifically, the resulting product was comprised of about 92 percent of shell polymer of poly(styrene-butyl acrylate-2 carboxyethyl acrylate), and Yellow Pigment 17, about 8 percent by weight, wherein the polymer shell possessed an average thickness of about 85 nanometers, which was determined by transmission electron microscope image analysis of a thin section of the yellow pigment encapsulated latex. The shell polymer possessed an $M_w$, of 29,000, an $M_n$ of 6,200, as determined on a Waters GPC, and a mid-point Tg of 52.6° C., as measured on a Seiko DSC.

Yellow Toner Particles

370 Grams of the above encapsulated yellow pigment, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 47° C. for 2 hours before 26 milliliters of 20 percent aqueous BIOSOFT D-40™ solution (sodium dodecyl benzene sulfonate, available from Stepan) were added. Subsequently, the resulting mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.18 as measured on a Coulter Counter. The resulting yellow toner was comprised of about 92 percent of the polymer poly(styrene-butyl acrylate-2-carboxyethyl acrylate), and Yellow Pigment Y-17, about 8 percent by weight of the toner, and wherein the total amount of the toner components was about 100 percent.

Toner Triboelectric Charge Evaluation

In 120 milliliter glass bottles, 1 gram of the above prepared yellow toner was added to 24 grams of carrier particles comprised of 90 micron diameter ferrite core, spray coated with 0.5 weight percent of a terpolymer of poly (methyl methacrylate), styrene, and vinyltriethoxysilane with a coating weight of 1 percent. For each combination of toner and carrier, the above developer mixture was retained in an environmental chamber at either 20 percent relative humidity, 50 percent relative humidity, or 80 percent relative humidity overnight, about 16 hours. The bottles were then sealed, and the toner and carrier particles were mixed by roll milling for 30 minutes to obtain a stable triboelectric charge. The toner charge was measured using the standard Faraday Cage tribo blow-off apparatus.

Triboelectric charge evaluation indicated that the toner of this Example had a toner tribo of −35 $\mu$C/gram (microcoulombs per gram) at 20 percent relative humidity, −28 $\mu$C/gram at 50 percent relative humidity, and −13 $\mu$C/gram at 80 percent relative humidity.

EXAMPLE II

Encapsulated Cyan Pigment Synthesis

An encapsulated cyan pigment comprised of a cyan pigment core and a styrene/n-butyl acrylate/2-carboxyethyl acrylate terpolymer shell was synthesized by a semicontinuous, miniemulsion polymerization process. 1-Dodecanethiol, with a solubility in water of $3.0\times10^{-5}$ grams per liter of water at 25° C., was used (1-dodecanethiol has a dual function as a cosurfactant for the miniemulsion and as a primary chain transfer agent for polymer molecular weight regulation). In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 765 grams of deionized water were deaerated for 30 minutes while the temperature was raised to 80° C. A miniemulsion was prepared by homogenizing a monomer mixture (303 grams of styrene, 101 grams of n-butyl acrylate, 24.3 grams of 2-carboxyethyl acrylate, 2 grams of 2,2'-azobis(2-methylbutyronitrile), 20.2 grams of 1-dodecanethiol, and 54.6 grams of cyan 15:3 pigment) with an aqueous solution (1.3 grams of DOWFAX 2A1™, 0.4 gram of ANTAROX CA-897™, 4.1 grams of ammonium persulfate, and 258 grams of deionized water) via VirTishear Cyclone Homogenizer at 10,000 rpm for 30 minutes at room temperature. The miniemulsion was fed into the reactor over 115 minutes. At the conclusion of the monomer feed, the emulsion was post-heated at 80° C. for 30 minutes, then there was added an initiator aqueous solution (2 grams of ammonium persulfate and 20 grams of deionized water). After the above initiator addition was completed, the reaction was allowed to post react for 90 minutes at 80° C., then cooled to 25° C. The resulting encapsulated cyan pigment contained 28 percent solids comprised of poly(styrene-butyl acrylate-2-carboxyethyl acrylate) and cyan pigment 15:3, and possessed an average particle size of 343 nanometers as measured by light scattering technique on a Coulter N4 Plus Particle Sizer. The resulting encapsulated product was comprised of about 96.3 percent of polymer, poly(styrene-butyl acrylate-2-carboxyethyl acrylate), and cyan pigment 15:3, about 3.7 percent by weight, and more specifically, the resulting encapsulated product was comprised of a cyan pigment core and a poly(styrene-butyl acrylate-2-carboxyethyl acrylate) polymer shell, wherein the polymer shell possessed an average thickness of about 95 nanometers as determined by transmission electron microscope image analysis. The polymer possessed an $M_w$ of 31,000, an $M_n$ of 7,400, as determined on a Waters GPC, and a mid-point Tg of 51.4° C., as measured on a Seiko DSC.

Cyan Toner Particles

370 Grams of the above encapsulated cyan pigment, and 2.3 grams of the cationic surfactant SANIZOL B-50™ were simultaneously added to 510 milliliters of water with high shear stirring at 7,000 rpm for 3 minutes by means of a polytron. The resulting mixture was then transferred to a 2 liter reaction vessel and heated at a temperature of 46° C. for 2 hours before 26 milliliters of 20 percent aqueous BIO-SOFT D-40™ solution (sodium dodecyl benzene sulfonate, available from Stepan) were added. Subsequently, the mixture was heated to 93° C. and held there for a period of 4 hours before cooling down to room temperature, about 25° C. throughout, filtered, washed with water, and dried in a freeze dryer. The final toner product evidenced a particle size of 6.9 microns in volume average diameter with a particle size distribution of 1.19 as measured on a Coulter Counter. The resulting toner, that is the above final toner product, was comprised of about 96.3 percent of polymer, poly(styrene-butyl acrylate-2-carboxyethyl acrylate), and Cyan Pigment 15:3, about 3.7 percent by weight of toner. Triboelectric charge evaluation indicated that the toner of this Example had a toner tribo of −35 $\mu$C/gram (microcoulombs per gram) at 20 percent relative humidity, −27 $\mu$C/gram at 50 percent relative humidity, and 12 $\mu$C/gram at 80 percent relative humidity.

EXAMPLE III

Magenta Encapsulated Pigment Formulation and Synthesis

An encapsulated magenta pigment comprised of a magenta pigment core and a styrene/n-butyl acrylate/2-carboxyethyl acrylate terpolymer shell was synthesized by semicontinuous, miniemulsion polymerization process. 1-Dodecanethiol, with a solubility in water of $3\times10^{-5}$ grams per liter of water at 25° C., was selected as the cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 656 grams of deionized water were deaerated for 30 minutes while the temperature was raised to 80° C. A miniemulsion was prepared by homogenizing a monomer mixture (296 grams of styrene, 99 grams of n-butyl acrylate, 25 grams of 2-carboxyethyl acrylate, 2 grams of 2,2'-azobis(2-methylbutyronitrile), 9 grams of 1-dodecanethiol, and 25.2 grams of Magenta 81.3 pigment) with an aqueous solution (1.3 grams of DOWFAX 2A1™, 0.4 gram of ANTAROX CA-897™, 4 grams of ammonium persulfate, and 224 grams of deionized water) via VirTishear Cyclone Homogenizer at 10,000 rpm for 30 minutes at room temperature. The miniemulsion was fed into the reactor over 180 minutes. At the conclusion of the monomer feed, the emulsion was post-heated at 80° C. for 30 minutes, followed by the addition of an initiator aqueous solution (1.9 grams of ammonium persulfate and 20 grams of deionized water). After the above initiator addition was completed, the reaction was allowed to post react for 90 minutes at 80° C., then cooled to 25° C. The resulting encapsulated magenta pigment contained 26 percent solids comprised of poly(styrene-butyl acrylate-2-carboxyethyl acrylate) and Magenta Pigment 81.3, and possessed an average particle size of 493 nanometers as measured by light scattering technique on a Coulter N4 Plus Particle Sizer, and more specifically, the resulting encapsulated product was comprised of about 95 percent of shell polymer, poly (styrene-butyl acrylate-2-carboxyethyl acrylate), and magenta pigment 81.3, about 5 percent by weight, wherein the polymer shell possessed an average thickness of about 80 nanometers, as determined by transmission electron microscope image analysis of a thin section of the magenta pigment encapsulated latex. The polymer possessed an $M_w$, of 32,600, an $M_n$ of 6,400, as determined on a Waters GPC, and a mid-point Tg of 50.9° C., as measured on a Seiko DSC.

Magenta Toner Particles

400 Grams of the above encapsulated magenta pigment, and 2.6 grams of cationic surfactant SANIZOL B-50™ were simultaneously added to 510 milliliters of water with high shear stirring at 7,000 rpm for 3 minutes by means of a polytron. The resulting mixture was then transferred to a 2 liter reaction vessel and heated at a temperature of 46° C. for 2 hours before 26 milliliters of 20 percent aqueous BIO-SOFT D-40™ solution (sodium dodecyl benzene sulfonate, available from Stepan) were added. Subsequently, the mixture was heated to 93° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.24 as measured on a Coulter Counter. The resulting toner was comprised of about 95 percent of polymer, poly(styrene-butyl acrylate-2-carboxyethyl acrylate), and magenta pigment 81.3, about 5 percent by weight of toner. Triboelectric charge evaluation indicated that the toner of this Example had a toner tribo of −34 μC/gram (microcoulombs per gram) at 20 percent relative humidity, −28 μC/gram at 50 percent relative humidity, and −12 μC/gram at 80 percent relative humidity.

EXAMPLE IV

Black Encapsulated Pigment Formulation and Synthesis

An encapsulated black pigment comprised of a pigment core and a styrene/n-butyl acrylate/2-carboxyethyl acrylate terpolymer shell was synthesized by semicontinuous, mini-emulsion polymerization process. 1-Dodecanethio, with a solubility in water of $3\times10^{-5}$ grams per liter of water at 25° C., was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 656 grams of deionized water were deaerated for 30 minutes while the temperature was raised to 80° C. A miniemulsion was prepared by homogenizing a monomer mixture (296 grams of styrene, 99 grams of n-butyl acrylate, 24 grams of 2-carboxyethyl acrylate, 2 grams of 2,2'-azobis (2-methylbutyronitrile), 7 grams of 1-dodecanethiol, and 21.1 grams of REGAL 330® carbon black pigment) with an aqueous solution (1.3 grams of DOWFAX 2A1™, 0.4 gram of ANTAROX CA-897™, 4 grams of ammonium persulfate, and 227 grams of deionized water) via VirTishear Cyclone Homogenizer at 10,000 rpm for 30 minutes at room temperature. The miniemulsion was then fed into the reactor over 180 minutes. At the conclusion of the monomer feed, the emulsion was post-heated at 80° C. for 30 minutes, then there was added an initiator aqueous solution (1.9 grams of ammonium persulfate and 20 grams of deionized water). After the above initiator addition was completed, the reaction was allowed to post react for 90 minutes at 80° C., then cooled to 25° C. The resulting encapsulated black pigment contained 27 percent solids which was comprised of a shell of poly(styrene-butyl acrylate-2-carboxyethyl acrylate) and REGAL 330® carbon black pigment, which possessed an average particle size of 239 nanometers as measured by light scattering technique on a Coulter N4 Plus Particle Sizer, and more specifically, the resulting encapsulated product was comprised of about 95 percent of polymer, poly(styrene-butyl acrylate-2-carboxyethyl acrylate), and REGAL 330® carbon black pigment, about 5 percent by weight, wherein the polymer shell possessed an average thickness of about 65 nanometers, as determined by transmission electron microscope image analysis. The polymer possessed an $M_w$ of 29,500, an $M_n$ of 5,200, as determined on a Waters GPC, and a mid-point Tg of 52.3° C., as measured on a Seiko DSC.

Black Toner Particles

385 Grams of the above black encapsulated pigment, and 2.6 grams of the cationic surfactant SANIZOL B-50™ were simultaneously added to 510 milliliters of water with high shear stirring at 7,000 rpm for 3 minutes by means of a polytron. The resulting mixture was then transferred to a 2 liter reaction vessel and heated at a temperature of 47° C. for 2 hours before 26 milliliters of 20 percent aqueous BIO-SOFT D-40™ solution (sodium dodecyl benzene sulfonate, available from Stepan) were added. Subsequently, the mixture was heated to 93° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.20 as measured on a Coulter Counter. The resulting toner was comprised of about 95 percent of polymer, poly(styrene-butyl acrylate-2-carboxyethyl acrylate), and REGAL 330® carbon black pigment, about 5 percent by weight of toner. Triboelectric charge evaluation indicated that the toner of this Example had a toner tribo of −33 μC/gram (microcoulombs per gram) at 20 percent relative humidity, −26 μC/gram at 50 percent relative humidity, and −11 μC/gram at 80 percent relative humidity.

COMPARATIVE EXAMPLE I

Polymer Latex Synthesis

A latex was prepared by the semicontinuous emulsion polymerization of styrene/butyl acrylate/2-carboxyethyl acrylate, 75/25/6 parts (by weight), as follows. A 2 liter jacketed glass flask with a stirrer set at 200 rpm, and containing 8.8 grams of DOWFAX 2A1™ (sodium tetrapropyl diphenyloxide disulfonate, 47 percent active, available from Dow Chemical), 3 grams of polyoxyethylene nonyl phenyl ether nonionic surfactant, ANTAROX CA 897™ (70 percent active, octylphenol aromatic ethoxylate, Rhone-Poulenc), and 519 grams of deionized water was purged with nitrogen for 30 minutes while the temperature was from about 25° C. to about 80° C. A monomer emulsion was prepared by homogenizing a monomer mixture (405 grams of styrene, 135 grams of n-butyl acrylate, 32.4 grams of 2-carboxyethyl acrylate, and 7.1 grams of 1-dodecanethiol) with an aqueous solution (4.4 grams of DOWFAX 2 A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed were removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring was continued for an additional 20 minutes to allow a seed particle formation. The remaining 795 grams of monomer emulsion were fed continuously into the reactor over 4 hours and 20 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting polymer of poly(styrene-butyl acrylate-acrylic acid-2 carboxyethyl acrylate) polymer possessed an $M_w$ of 31,200, and an $M_n$ of 8,400, as determined on a Waters GPC, and a mid-point Tg of 52.0° C., as measured on a Seiko DSC. The latex monomer possessed a volume average diameter of 202 nanometers as measured by light scattering technique on a Coulter N4 Plus Particle Sizer.

COMPARATIVE EXAMPLE IA

Yellow Toner Particles Prepared by Aggregation of Polymer Latex and Yellow Pigment Dispersion 260 Grams of the above prepared latex emulsion of Comparative Example I and 220 grams of an aqueous yellow pigment dispersion containing 45 grams of Yellow Pigment Y-17 (21 percent solids), and 2.6 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.3 microns with a GSD=1.20, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7 microns in volume average diameter with a particle size distribution of 1.21 as measured on a Coulter Counter.

The resulting toner, that is the above final toner product, was comprised of about 92 percent of the polymer poly (styrene-butyl acrylate-2-carboxyethyl acrylate), and Yellow Pigment Y-17, about 8 percent by weight of toner, with an volume average diameter of 7 microns and a GSD of 1.21.

Triboelectric charge evaluation indicated that the toner of this Comparative Example had a toner tribo of −42 μC/gram (microcoulombs per gram) at 20 percent relative humidity, −35 μC/gram at 50 percent relative humidity, and −10 μC/gram at 80 percent relative humidity.

COMPARATIVE EXAMPLE IB

Cyan Toner Particles Prepared by Aggregation of Polymer Latex and Cyan Pigment Dispersion 260 Grams of the above prepared latex emulsion of Comparative Example I and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent an aqueous surfactant BIOSOFT D-40™ solution were added. Aggregates with a particle size (volume average diameter) of 6.7 microns with a GSD=1.17, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 7 microns in volume average diameter with a particle size distribution of 1.20 as measured on a Coulter Counter.

The resulting toner, that is the above final toner product, was comprised of about 96 percent of the above prepared polymer poly(styrene-butyl acrylate-2-carboxyethyl acrylate), and Cyan Pigment 15:3, about 4 percent by weight of toner, and which toner possessed a volume average diameter of 7 microns and a GSD of 1.20.

Triboelectric charge evaluation indicated that the toner of this Comparative Example had a toner tribo of −36 μC/gram (microcoulombs per gram) at 20 percent relative humidity, −28 μC/gram at 50 percent relative humidity, and −16 μC/gram at 80 percent relative humidity.

COMPARATIVE EXAMPLE IC

Magenta Toner Particles Prepared by Aggregation of Polymer Latex and Magenta Pigment Dispersion 260 Grams of the above prepared latex emulsion of Comparative Example I and 220 grams of an aqueous magenta pigment dispersion containing 24 grams of Magenta Pigment 81.3 (21 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent aqueous BIOSOFT D-40™ solution were added. Aggregates with a particle size (volume average diameter) of 6.6 microns with a GSD=1.17, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.24 as measured on a Coulter Counter.

The resulting toner, that is the above final toner product, was comprised of about 95 percent of polymer, poly (styrene-butyl acrylate-2-carboxyethyl acrylate), and Magenta Pigment 81.3, about 5 percent by weight of toner, with a volume average diameter of 7.1 microns and a GSD of 1.24.

Triboelectric charge evaluation indicated that the toner of this Comparative Example had a toner tribo of −33 μC/gram (microcoulombs per gram) at 20 percent relative humidity, −24 μC/gram at 50 percent relative humidity, and −7 μC/gram at 80 percent relative humidity.

COMPARATIVE EXAMPLE ID

Black Toner Particles Prepared by Aggregation of Polymer Latex and Black Pigment Dispersion 260 Grams of the above prepared latex emulsion of Example I and 220 grams of an aqueous black pigment dispersion containing 7.6 grams of Black Pigment REGAL 330® carbon black (21 percent solids), and 2.6 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.2 microns with a GSD=1.19, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 6.7 microns in volume average diameter with a particle size distribution of 1.21 as measured on a Coulter Counter.

The resulting toner, that is the above final toner product, was comprised of about 95 percent of the polymer poly (styrene-butyl acrylate-2-carboxyethyl acrylate), and black pigment REGAL 330® carbon black, about 5 percent by weight of toner, with an volume average diameter of 6.7 microns and a GSD of 1.21.

Triboelectric charge evaluation indicated that the toner of this Comparative Example had a toner tribo of −28 μC/gram (microcoulombs per gram) at 20 percent relative humidity, −20 μC/gram at 50 percent relative humidity, and −5 μC/gram at 80 percent relative humidity.

TABLE 1

Tribocharge Evaluation of Toner Particles

| Pigment | Example I Yellow | Example II Cyan | Example III Magenta | Example IV Black |
|---|---|---|---|---|
| Q/M (μC/gram) @ 60° F./20 percent RH | −35 | −35 | −34 | −33 |
| Q/M (μC/gram) @ 70° F./50 percent RH | −28 | −27 | −28 | −26 |
| Q/M (μC/gram) @ 80° F./80 percent RH | −13 | −12 | −12 | −11 |

TABLE 2

Tribocharge Evaluation of Comparative Toner Particles Made By Aggregation of Polymer Latex and Pigment Dispersion

| Pigment | Comparative Example IA Yellow | Comparative Example IB Cyan | Comparative Example IC Magenta | Comparative Example ID Black |
|---|---|---|---|---|
| Q/M (μC/gram) @ 60° F./20 percent RH | −42 | −36 | −33 | −28 |
| Q/M (μC/gram) @ 70° F./50 percent RH | −35 | −28 | −24 | −20 |
| Q/M (μC/gram) @ 80° F./80 percent RH | −10 | −16 | −7 | −5 |

The Triboelectric charge evaluation at different relative humidity (RH) of the toners in Examples I to IV is summarized in Table 1, and wherein the triboelectric charge evaluation at different relative humidity (RH) of the toners in Comparative Examples IA to ID is summarized in Table 2. As shown in the tables, it was found that the toner particles generated with encapsulated pigment latexes possessed substantially uniform triboelectric toner charging, wherein the difference in tribocharging among different fourcolor toners in different relative humilities was only about 2 μC/gram. In Comparative Examples IA to ID, the difference in tribocharging among different four-color toners is from about 11 to about 15 μC/gram. This indicates that the encapsulated pigments of the present invention can provide uniform tribo charge for yellow, cyan, magenta, and black toners, and result in toners with similar charging behavior independent of the colorant or pigment type selected.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of a toner comprising the emulsion polymerization of a miniemulsion of monomer, colorant, ionic surfactant, cosurfactant, and optional nonionic surfactant, and wherein the resulting encapsulated colorant containing a polymer shell is of a diameter of from about 100 to about 1,000 nanometers, and wherein said encapsulated colorant containing a polymer shell is aggregated below about the polymer glass transition temperature, followed by coalescing or fusing of said aggregates above about the polymer glass transition temperature, and wherein there results a toner with a size of from about 2 to about 20 microns in volume average diameter; and wherein the colorant is carbon black, magnetite, cyan, yellow, magenta, or mixtures thereof.

2. A process in accordance with claim 1 wherein said diameter is from about 200 to about 600 nanometers.

3. A process in accordance with claim 1 wherein said temperature below the polymer shell glass transition temperature is from about 25° C. to about 60° C., and the heating above the polymer shell glass transition temperature is from about 60° C. to about 100° C.

4. A process in accordance with claim 1 wherein said temperature below the glass transition temperature is from about 35° C. to about 55° C., and the heating above the glass transition temperature is from about 70° C. to about 95° C.

5. A process in accordance with claim 1 wherein the temperature at which said aggregation is accomplished controls the size of the aggregates, and wherein said toner size is from about 2 to about 12 microns in volume average diameter, and wherein the temperature and time of said coalescence or fusion of the components of aggregates control the shape of the resultant toner.

6. A process in accordance with claim 1 wherein the aggregation temperature is from about 45° C. to about 55° C., and wherein the coalescence or fusion temperature is from about 80° C. to about 95° C.

7. A process in accordance with claim 1 wherein the cosurfactant is selected from the group consisting of alkanes, alcohols, ethers, alkyl thiols, amines, halides, and esters.

8. A process in accordance with claim 1 wherein the cosurfactant is an alkane with from about 10 to about 24 carbon atoms, and wherein said alkane is present in an amount of from about 0.05 to about 5 weight percent based on the amount of monomer.

9. A process in accordance with claim 1 wherein the cosurfactant is an alcohol, or an alkyl thiol.

10. A process in accordance with claim 9 wherein the alcohol contains from about 8 to about 20 carbon atoms.

11. A process in accordance with claim 9 wherein the alcohol is decanol, lauryl alcohol, tetradecanol, cetyl alcohol, or octadecanol.

12. A process in accordance with claim 9 wherein the alcohol is present in an amount of from about 0.1 to about 5 weight percent.

13. A process in accordance with claim 9 wherein the alkyl thiol contains from about 10 to about 18 carbon atoms, and is present in an amount of from about 0.1 to about 5 weight percent.

14. A process in accordance with claim 9 wherein the alkyl thiol is decanethiol, 1-dodecanethiol, t-dodecanethiol, or octadecanethiol.

15. A process in accordance with claim 1 wherein the cosurfactant is n-decane, dodecane, tetradecane, hexadecane, octadecane octyne, dodecyl cyclohexane, or hexadecyl benzene.

16. A process in accordance with claim 1 wherein said aggregates are formed in the presence of a cationic surfactant.

17. A process in accordance with claim 1 wherein the aggregation is accomplished at a temperature of from about 15° C. to about 1° C. below the Tg of the polymer for an optional duration of from about 0.5 hour to about 3 hours, and wherein said polymer is poly(styrene-alkyl acrylate-acrylic acid), poly(styrene-1,3-diene-acrylic acid), or poly (styrene-alkyl acrylate-2-carboxyethyl acrylate).

18. A process in accordance with claim 1 wherein the coalescence or fusion of the components of aggregates for the formation of integral toner particles is accomplished at a temperature of about 85° C. to about 105° C. for a duration of from about 1 hour to about 5 hours.

19. A process in accordance with claim 1 wherein the polymer shell is selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(alkyl methacrylate-2-carboxyethyl acrylate), poly(styrene-alkyl acrylate-2-carboxyethyl acrylate), poly(styrene-alkyl acrylate-acrylonitrile-2-carboxyethyl acrylate), poly(styrene-1,3-diene-acrylonitrile-2-carboxyethyl acrylate), and poly(alkyl acrylate-acrylonitrile-2-carboxyethyl acrylate), wherein said polymer is optionally present in an amount of from about 80 percent by weight to about 99 percent by weight of toner.

20. A process in accordance with claim 1 wherein the polymer shell and the toner contains a polymer selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-2-carboxyethyl acrylate), poly(styrene-butadiene-acrylonitrile-2-carboxyethyl acrylate), poly(styrene-butyl acrylate-2-carboxyethyl acrylate), and poly(styrene-butyl acrylate-acrylononitrile-2-carboxyethyl acrylate).

21. A process in accordance with claim 1 wherein said polymer shell and the toner contains a polymer of poly (styrene-butyl acrylate-acrylic acid), poly(styrene-butyl acrylate-2-carboxyethyl acrylate), or poly(styrene-butadiene-acrylic acid).

22. A process in accordance with claim 1 wherein the ionic surfactant is selected from the group consisting of sodium dodecyl sulfate, sodium dodecylbenzene sulfate, sodium dodecylnaphthalene sulfate, and sodium tetrapropyl diphenyloxide disulfonate.

23. A process in accordance with claim 1 wherein the toner particles isolated are from about 2 to about 10 microns in volume average diameter, and the particle size distribution thereof GSD is from about 1.15 to about 1.30, wherein each of the surfactants utilized represents from about 0.01 to about 5 weight percent of the total reaction mixture, and wherein there is optionally added to the surface of the formed toner metal salts, metal salts of fatty acids, silicas, metal oxides, or mixtures thereof, each in an amount of from about 0.1 to about 10 weight percent of the obtained toner particles, and wherein the solids of the miniemulsion of monomer, colorant, and surfactants is of a diameter of from about 200 to about 600 nanometers.

24. A process in accordance with claim 1 wherein the colorant encapsulated in said polymer shell is prepared by a free radical-initiated aqueous miniemulsion polymerization of a mixture of olefinic monomers, free radical initiator, chain transfer agent, ionic surfactant, cosurfactant, and water, wherein the amount of monomers selected is from about 1 to about 40 weight percent, and the amount of water is from about 59 to about 98 weight percent, based on the total reaction mixture amount by heating at a temperature of between about 45° C. to about 90° C., wherein the resulting polymer possesses a number average molecular weight of from about 1,000 grams per mole to about 200,000 grams per mole, a weight average molecular weight of from about 5,000 grams per mole to about 500,000 grams per mole, and a glass temperature of from about 40° C. to about 120° C., wherein said colorant is present in an amount of from about 1 to about 25 weight percent based on the monomer amount, the free radical initiator is selected in an amount of from about 0.1 to about 10 weight percent based on the monomer or monomers amount, the chain transfer agent is selected in an amount of from about 0.5 to about 10 weight percent based on the monomer or monomers amount, the ionic surfactant is selected in an amount of from about 0.1 to about 10 weight percent based on the monomer or monomers amount, the cosurfactant is selected in an amount of from about 0.005 to about 5 weight percent, based on the monomer or monomers amount, wherein said miniemulsion is of an average diameter of from about 100 nanometers to about 1,000 nanometers, as measured by light scattering.

25. A process in accordance with claim 1 wherein said miniemulsion is comprised of water, colorant, and said surfactants wherein said ionic surfactant is of a negative polarity, and said cosurfactant and nonionic surfactant are each of a neutral polarity.

26. A process in accordance with claim 1 wherein polymerization of said monomer is accomplished by heating.

27. A process in accordance with claim 26 wherein said heating is at a temperature of from about 45° C. to about 95° C.

28. A process in accordance with claim 1 wherein said nonionic surfactant is present.

* * * * *